US008291726B2

(12) United States Patent
Anderson

(10) Patent No.: US 8,291,726 B2
(45) Date of Patent: Oct. 23, 2012

(54) FOLDING LOCKET

(76) Inventor: James Anderson, Eagle, ID (US)

( * ) Notice: Subject to any disclaimer, the term of this patent is extended or adjusted under 35 U.S.C. 154(b) by 743 days.

(21) Appl. No.: 12/127,081

(22) Filed: May 27, 2008

(65) Prior Publication Data

US 2009/0293542 A1 Dec. 3, 2009

(51) Int. Cl.
*A44C 15/00* (2006.01)

(52) U.S. Cl. ..... 63/19

(58) Field of Classification Search ..... 63/1.14, 63/19, 1.11, 18; 16/367
See application file for complete search history.

(56) References Cited

U.S. PATENT DOCUMENTS

| | | | | |
|---|---|---|---|---|
| 711,516 | A | 10/1902 | Miller | |
| 770,573 | A | 9/1904 | Hacherelle | |
| 1,061,364 | A | 5/1913 | Ewing | |
| 1,655,341 | A | 1/1928 | Snellgrove | |
| 2,262,548 | A | 11/1941 | Genser | |
| 2,769,249 | A | 11/1956 | Illes | |
| 2,863,307 | A | 12/1958 | Donle | |
| 3,381,495 | A | 5/1968 | Emerson | |
| 3,624,939 | A | 12/1971 | Gossard | |
| 3,802,104 | A | 4/1974 | Wiley | |
| D247,881 | S | 5/1978 | Hitchens | |
| 4,224,364 | A | 9/1980 | Hunt | |
| 4,343,104 | A | 8/1982 | Szabo | |
| 4,542,631 | A * | 9/1985 | Esser, III | 63/31 |
| 4,581,904 | A | 4/1986 | Lehmann et al. | |
| 4,807,377 | A | 2/1989 | Stuckel | |
| 4,882,915 | A | 11/1989 | Porcaro | |
| 5,157,945 | A * | 10/1992 | Giehl | 63/33 |
| 5,367,891 | A * | 11/1994 | Furuyama | 63/29.2 |
| 5,586,452 | A | 12/1996 | Schmid | |
| 5,713,147 | A | 2/1998 | Johnson | |
| 6,145,341 | A | 11/2000 | Leong | |
| D464,287 | S | 10/2002 | Potter et al. | |
| 6,789,395 | B2 | 9/2004 | Molino et al. | |
| 7,162,978 | B2 * | 1/2007 | Debien | 119/772 |
| D538,196 | S | 3/2007 | Lee | |
| 7,654,110 | B2 * | 2/2010 | Azar | 63/3.1 |
| 7,788,774 | B1 * | 9/2010 | Cravey | 24/587.11 |

OTHER PUBLICATIONS

The Illusionist Locket Improved (Functional Remake) http://www.youtube.com/watch?v=NU2q71gako, Jul. 12, 2007.
Illusionist solid-photo locket, http:/www.youtube.com/watch?v=PaA-W9QUaYo, Aug. 16, 2007.
Colgante el ilusionista 3, http://www.youtube.com/watch?v=1vebXiYB-F4, Jul. 11, 2007.
Ebay.com, Locket Heart Pendant Illusionist Butterfly Necklace M—Item No. 220152441148.
Ebay.com, Illusionist Solid-Photo Locket! (working heart pendant)—Item No. 190155717504.

* cited by examiner

*Primary Examiner* — Jack W. Lavinder
*Assistant Examiner* — Abigail E Morrell
(74) *Attorney, Agent, or Firm* — Robert L. Shaver; Dykas & Shaver, LLP

(57) ABSTRACT

The invention is a folding locket which can take the form of an oblong or cylindrical locket, and can be folded into a generally heart shaped locket. In either of these configurations, oblong or heart, the locket can be opened by rotating the two halves of the locket apart. When the two halves of the locket are rotated apart, a picture, hidden on each side of the locket becomes visible; thus, opening the locket makes visible two pictures which can be selected by the user. The pictures displayed in the mounting are mounted in the position which spans the fold line of the locket.

13 Claims, 8 Drawing Sheets

FOLDING LOCKET

FIELD OF THE INVENTION

The invention is in the general field of lockets, and more specifically is related to folding lockets which hold pictures.

BACKGROUND OF THE INVENTION

Lockets which open and close to display a photograph are well known in the prior art. Also well known in the prior art are lockets which have a generally oblong shape and which fold into a generally heart shape. Several different mechanisms have been disclosed in the prior art which enable folding in this manner from an oblong shape to a heart shape. Certain of these heart folding lockets also include a position for mounting a photograph. Heart folding lockets of the prior art provide a photograph mounting position which is typically in each of the lobes of the heart. Since there is a seam down the center of the heart, photographs mounted in the lobes of the heart must be split down the middle in order for the locket to function.

Folding heart lockets of the prior art only provide a photograph position on one side of the heart. Certain of these folding heart lockets do not allow the locket to be open to display photographs when the locket is in both the oblong and the heart configuration.

The folding locket of the invention folds from an oblong shape into a heart shape, and in either the heart or the oblong shape may be opened to reveal two photograph mounting positions. These photograph mounting positions span across the split in the locket quadrants.

SUMMARY OF THE INVENTION

The invention is a folding locket which is made up of four quarter units, with the quarter units being designated, first, second, third, and fourth. The invention can also be used in the form or a keychain fob, a pill case, a novelty item, or anything in which a secret compartment would be useful. The first and second quarter units are paired together to form a generally oblong first half of the locket. The third and fourth quarter units are paired together to form a generally oblong second half of the locket. Each of these locket halves has a long axis and a short axis, as well as a first end and a second end, and an inner face and an outer surface. The inner face is a flat surface and is configured to interface with the inner face of the other half of the locket. Each of the quarter units of each of the halves are configured to be rotatably joined to the other quarter unit. Thus, the first quarter unit is rotatably joined to the second quarter unit, and the third quarter unit is rotatably joined to the fourth quarter unit.

Each of the quarter units contains a quarter portion of a middle swivel joint, or the joining structure may be made from the material of the locket. For instance, the entire locket can be made of a material, such as wood, metal, jade, stone, plastic, or any other suitable material. Each of these portions of the swivel joint is mounted fixedly in the quarter unit of the locket. The swivel is what connects the first quarter unit and the second quarter unit, and it also connects the third quarter unit and the fourth quarter unit. By means of the swivel, the second quarter unit is able to rotate in relation to the first quarter unit and the third quarter unit is able to rotate in relation to the fourth quarter unit.

The two oblong halves of the locket are also rotatably joined to each other so that one locket half can rotate 360° in relation to the other locket half. The inner face between the first quarter unit and the second quarter unit of the first locket half forms a joint line, and the second locket half has a corresponding joint line.

The folding locket has a first position and a second position. In the first position, the first and second locket halves are aligned so that they form a generally oblong locket. The quarter units can also rotate along the first and second joint lines 180 degrees, so that the locket forms a heart shape. The joint lines can also be formed to not form a heart but to rotate the lower part of the locket in relation to another part. To form the heart shape, the second and fourth quarter units rotate as a pair in relation to the first and third quarter units of the locket. Due to the oblong nature of the locket halves, and the angle of the first and second joint line, the oblong locket can fold into a heart shaped locket with a simple twisting motion.

The movement of the locket from oblong shape to heart shape is accomplished by the four piece swivel, or its equivalent.

The first and second half of the locket can also be moved apart when the locket is in the first or oblong position to reveal a cavity for holding something. One or two of the four locket swivel joint quarters can contain a photo mounting position which allows the picture to span across the joint line and be located more or less in the center of the locket half and on both sides of the first joint line. In addition to a picture mounting position in the first half of the locket, a similar picture mounting position is available on the second half of the folding locket. Both of these photo mounting positions are in the center of and surrounded by two quarters of the swivel mechanism.

Similarly, when the locket is moved to the second position of the heart shaped configuration, two photo mounting positions are also exposed, with one of these being viewable at a time, viewable by moving the heart to an open position. By having the photo mounting surfaces located on the second and fourth quarter swivels, a different photo will be viewable when the locket is opened in the oval position than is viewable when the locket is opened in the heart shaped position. Each half of the heart has a photo mounted position which is designed to receive a photograph and to make it visible. The photo is positioned over the center of the joint line on both sides of the heart, but the photo does not need to have a seam over the joint line. This is accomplished by having a cavity contained within the swivel joint assembly which provides clearance for the picture when the locket halves are rotated from the oval position to the heart position.

The device also has a hanging loop, and a rotating joint on one end of the locket, so that the two halves of the locket can rotate apart. The device also has a number of positioning magnets which are located on the various faces of the locket. The positioning magnets are configured so that, in certain positions, a pair of corresponding magnets will repel each other, which facilitates the moving of the locket to a different position. The repulsion is caused by positioning a magnet of a certain polarity opposite a magnet of the same polarity. Magnets are positioned so that they attract, rather than repel, to bring the locket quarters into alignment and to hold it in place by the attraction of the magnets. The attraction of the magnets is caused by positioning an alike with an unlike polarity of magnet in the desired position. Magnets are positioned on the inner face of the first and second halves of the locket. They are also positioned on the faces adjacent to the first and second joint lines, on either side of the quarter of the swivel which is in a particular quarter unit of the locket. The magnets are positioned with north and south poles arranged so that the sections repel each other in transit, and attract when in the first or second position.

The purpose of the foregoing Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
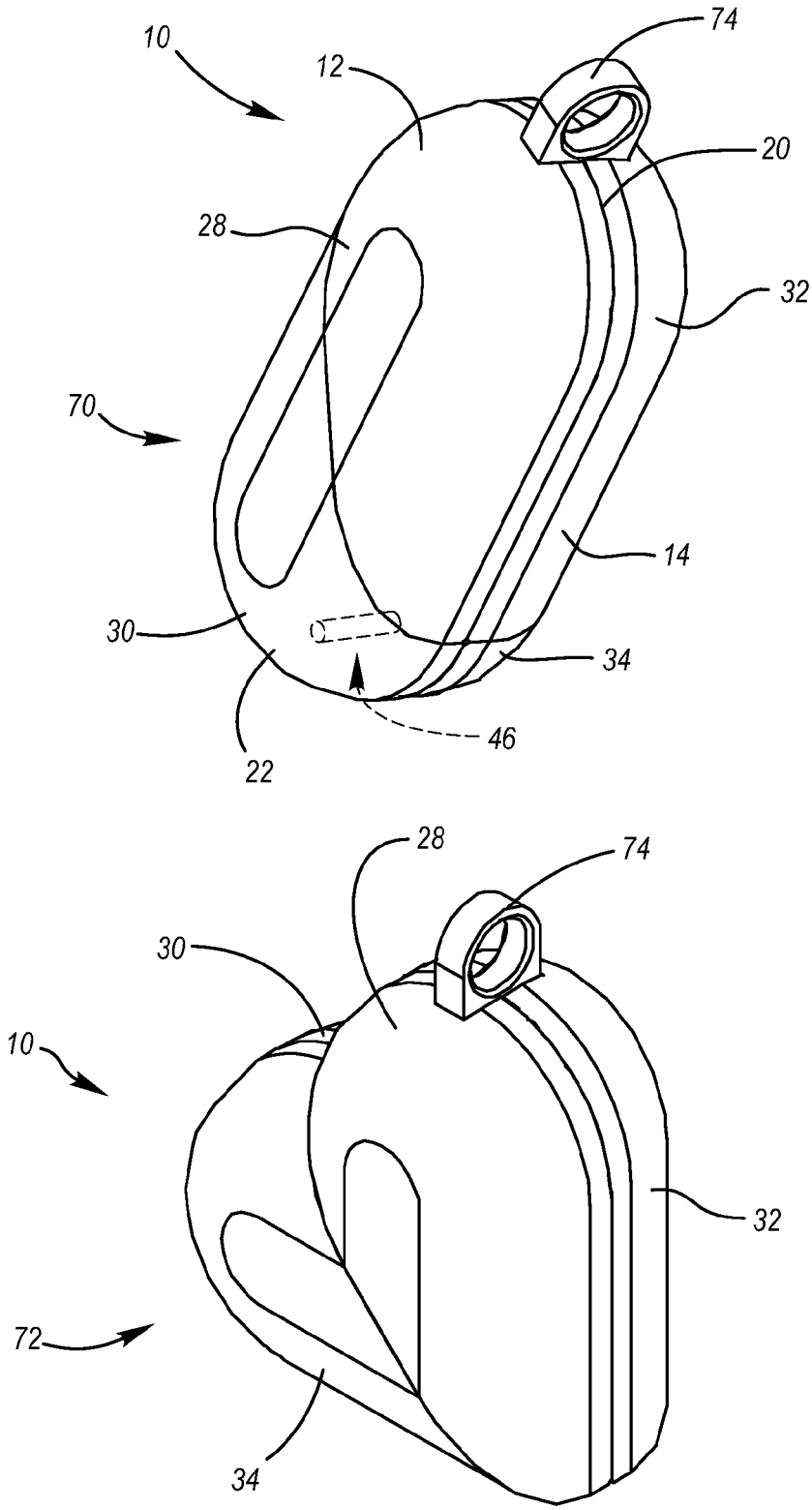
FIG. 1 is a perspective view of the locket of the invention. In an oblong and a heart configuration.

The invention is shown in more detail in FIGS. 1-9. FIG. 1 shows the folding locket 10 of the invention in a first position 70 and a second position 72. Shown in FIG. 1 is a generally oblong first half of the locket 12 and a generally oblong second half of the locket 14. The locket has a first end 20, and a second end 22. The locket is made up of four quadrants which are identified as first quarter unit 28, second quarter unit 30, third quarter unit 32 and fourth quarter unit 34. Between the second quarter unit 30 and the fourth quarter unit 34 is a rotating joint 46 which is internal to the pieces and is not visible from the outside.

In Figure one, the same locket is shown in the second position 72, with the four quarter units of the locket identified, and the locket twisted into a heart shape. A hanging attachment 74 is attached to the locket to enable it to be hung by a string or a chain.

Figure 2:
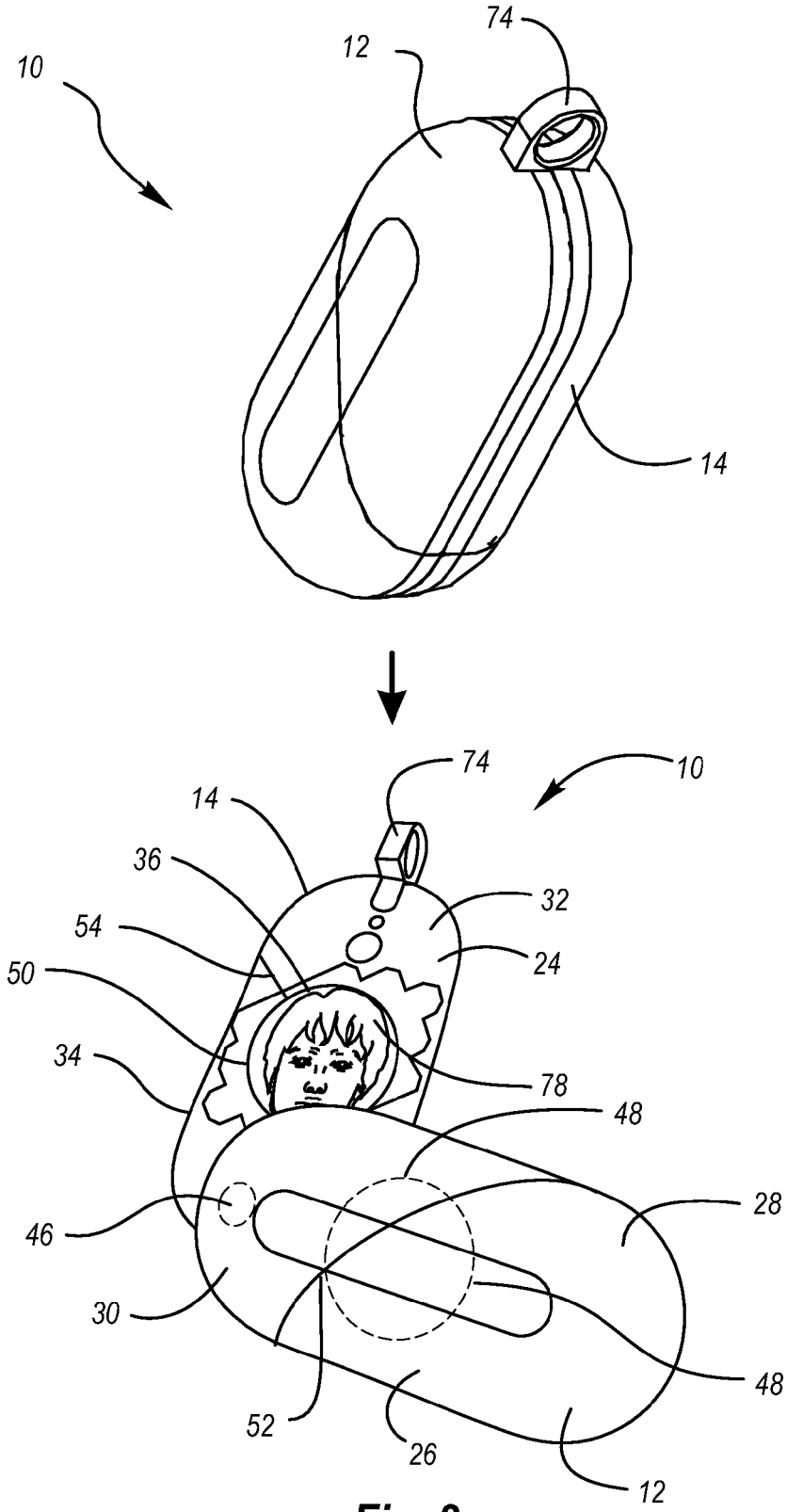
FIG. 2 is a perspective view of the locket of the invention showing an oblong configuration opening to reveal a picture.

FIG. 2 shows the locket 10 and its configuration which allows opening the locket by rotating the first half 12 away from the second half 14 about the rotating joint 46. Shown in FIG. 2 are the first quarter unit 28 and the second quarter unit 30 which are joined together, thus, rotatable as a unit away from the second half 14, which is made up of third quarter unit 32 and fourth quarter unit 34. Where the First 28 and second 30 quarter units join is seen as a first joint line 52. The inner face 24 of the second half 14 of the locket is visible in FIG. 2, as is the second joint line 54. Visible on the inner face 24 of the second half of the locket 14, is the swivel assembly 36, which is located on the second joint line 54. The swivel assembly 36 surrounds a second picture mounting position 50, with a second picture 78 shown inside the second picture mounting position 50.

Figure 3:
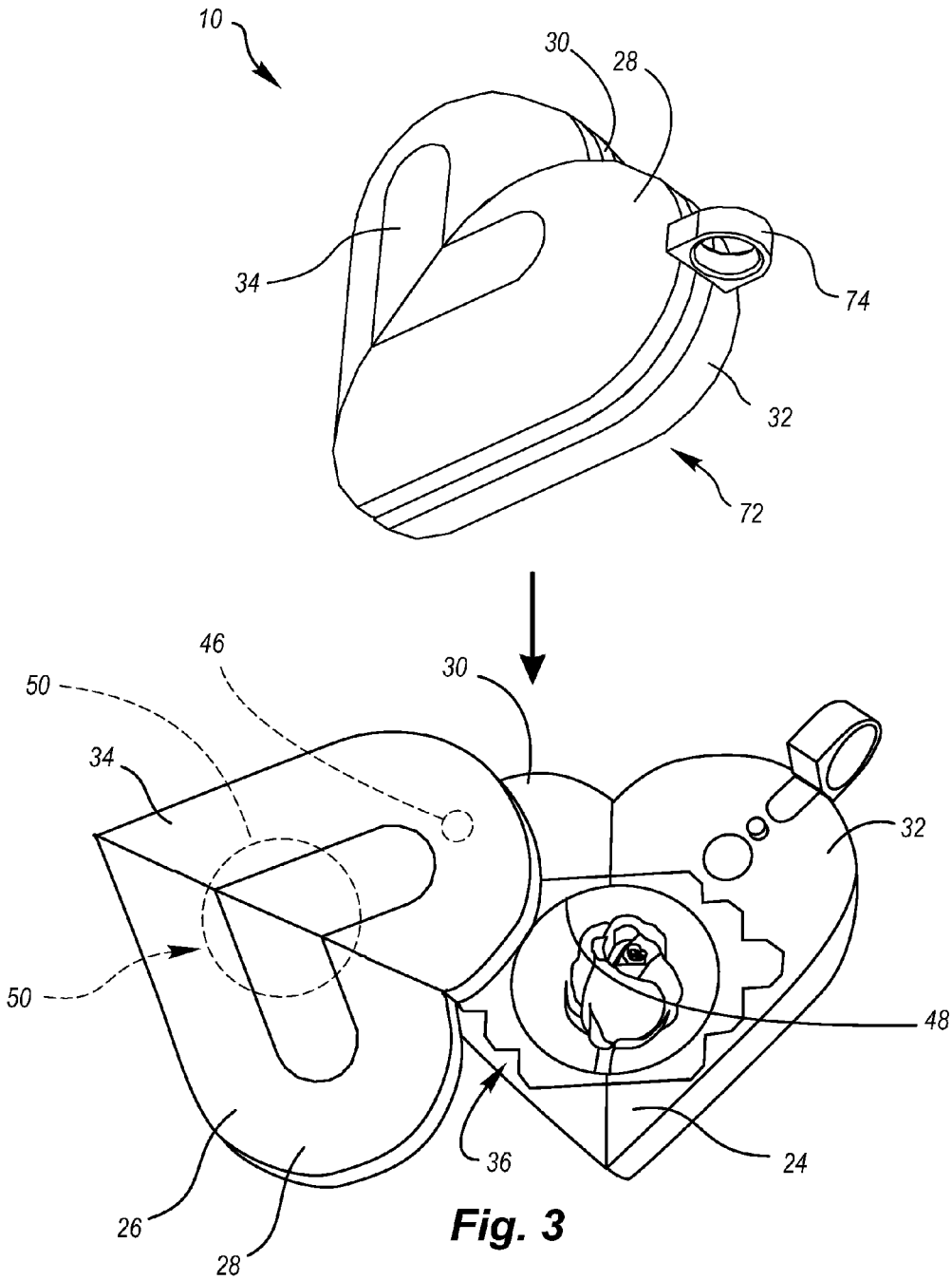
FIG. 3 is a perspective view of the locket of the invention showing the heart configuration opening to reveal a picture.

FIG. 3 shows the folding locket 10 of the invention in a second configuration 72, in which the locket is generally heart shaped. Shown is the hanging attachment 74, a first quarter unit 28, a second quarter unit 30, a third quarter unit 32 and a fourth quarter unit 34. A rotating joint 46 is positioned between the inner faces 24 of the quarter units of the locket. In this configuration, first quarter unit 28 is connected edge to edge to fourth quarter unit 34, third quarter unit 32 is connected edge to edge with second quarter unit 30. Shown in FIG. 3 are parts of the swivel assembly 36, which in this position shows the first picture mounting position 48. The second picture mounting position 50 is viewable on the interfaces of quarter units 34 and 28 but not visible from the viewpoint shown in FIG. 3. Shown is outer surface 26.

Figure 4:
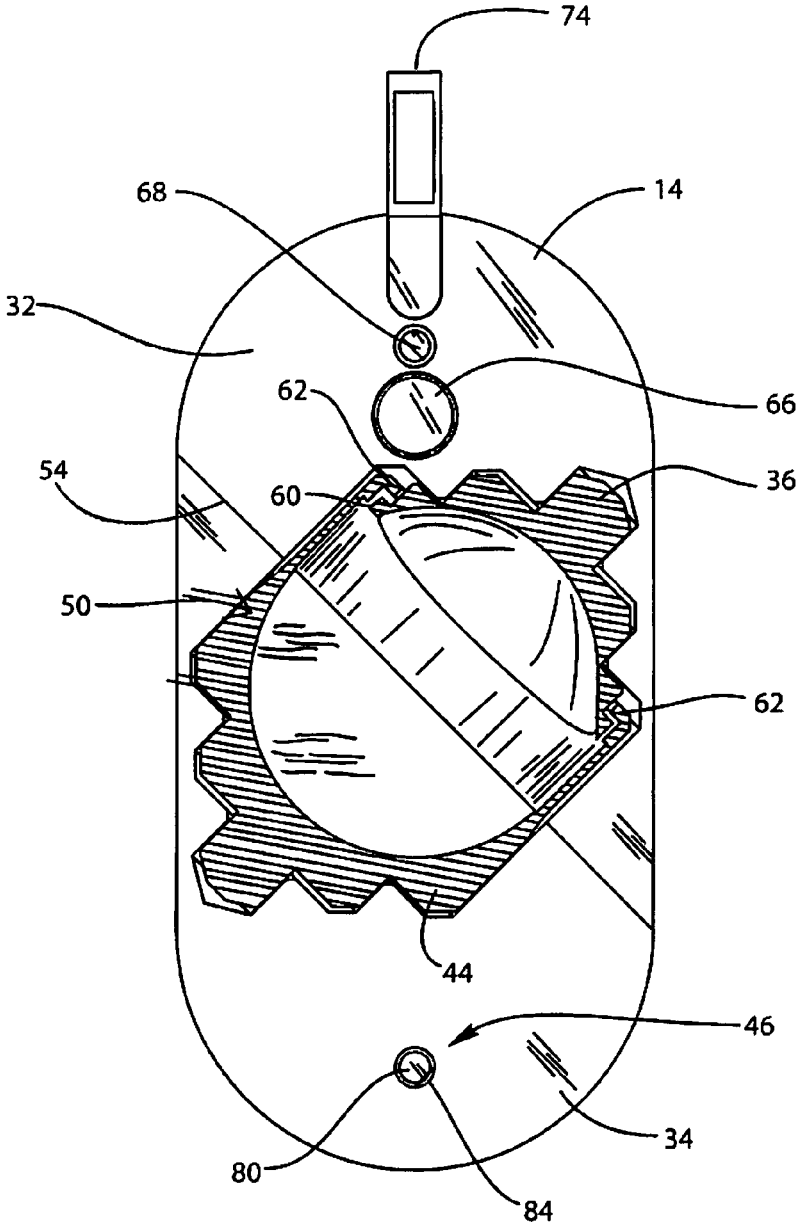
FIG. 4 is a front view of an inner face of the invention showing the swivel assembly and picture mounting position.

FIG. 4 is a front view of third quarter unit 32 and fourth quarter unit 34 of the locket of the invention which make up second half 14 of locket 10. Shown in FIG. 4 is a hanging attachment 74, a positioning magnet 66 and a detent 68. This view shows what the generally oblong second half 14 of the folding locket would look like if the first half 12 were removed. Visible in this view is a shaft 80 where the rotating joint 46 would fit and join the first half 12 and the second half 14 together. Also shown in FIG. 4 is the second picture mounting position 50 where a picture may be mounted and allowed to overhang into the third quarter of the locket and span the second joint line 54. Also shown in FIG. 4 is a third quarter 42 of the swivel and fourth quarter 44 of the swivel. A first quarter 38 of the swivel and a second quarter 40 of the swivel would be identical in nature and would be mounted in the first half 12 of the locket. The swivel assembly 36 is thus made of four quarters, with two of the quarters shown in FIG. 4. These two quarters are rotatably joined to each other by the rim 60 of the third quarter of the swivel 42, and by the retaining ridge 62 of the fourth quarter of the swivel 44. The rim 60 and retaining ridge 62 act together to allow quarter units 32 and 34 to rotate around each other while remaining attached. Since the first and third quarter units have similar swivel quadrants, and the second and fourth quarter units have similar swivel quadrants, as long as the four quarters are aligned accurately, the fourth quarter 34 and the second quarter 30 can also rotate around the joined first quarter 28 and the third quarter 32.

Shown in FIG. 4 is a positioning magnet 66, which is positioned to attract a corresponding positioning magnet of opposite polarity on the first half 12 of the locket. Other positioning magnets 66, detents 68, and detent recesses 82 are also present on the faces that form the first joint line and the second joint line, and cause the four pieces to snap into position as they approach their correct location in relation to each other.

Figure 5:
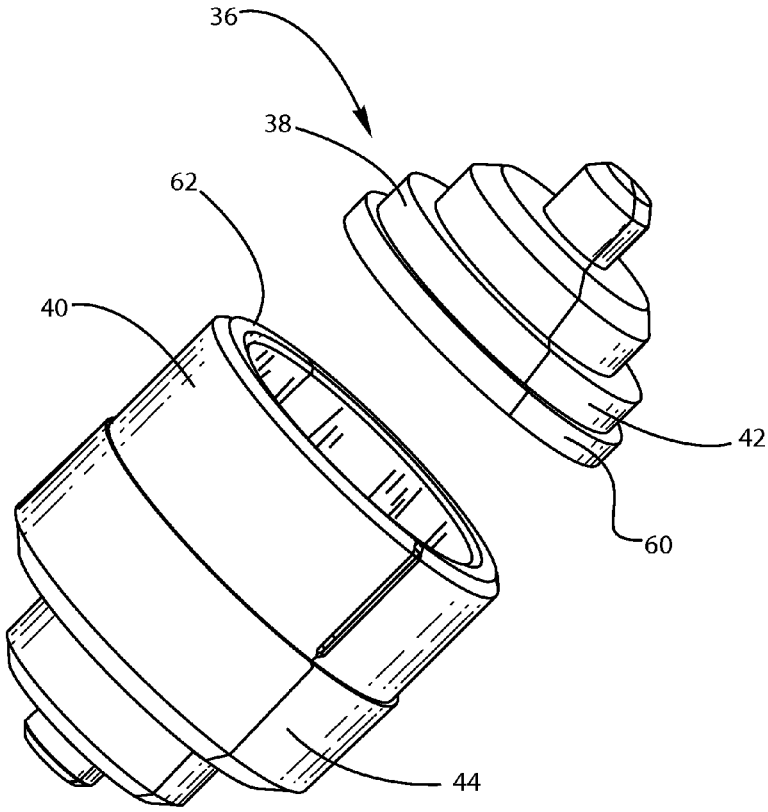
FIG. 5 is a perspective view of the four quadrants of the swivel assembly.

FIG. 5 shows a view of the four quarters of the swivel, with the locket pieces themselves removed. The swivel assembly 36 is shown, with the first quarter of the swivel being 38, second quarter of the swivel being 40, third quarter of the swivel being 42, and the fourth quarter of the swivel identified as 44. Located on the first and third quarter of the swivels is a rim 60, which interfaces with a retaining ridge 62, which is formed by the second quarter of the swivel and the fourth quarter of the swivel. When these four pieces are joined together, the first and third quarter of the swivel, 38 and 42, are free to rotate around the second and fourth quarter of the swivel, 40 and 44. Each of these quarters of the swivel is attached to a quarter unit of the locket, thus, each of the four quarters of the locket may rotate around each other as permitted by the swivels and by the rotating joint 46.

Figure 6:
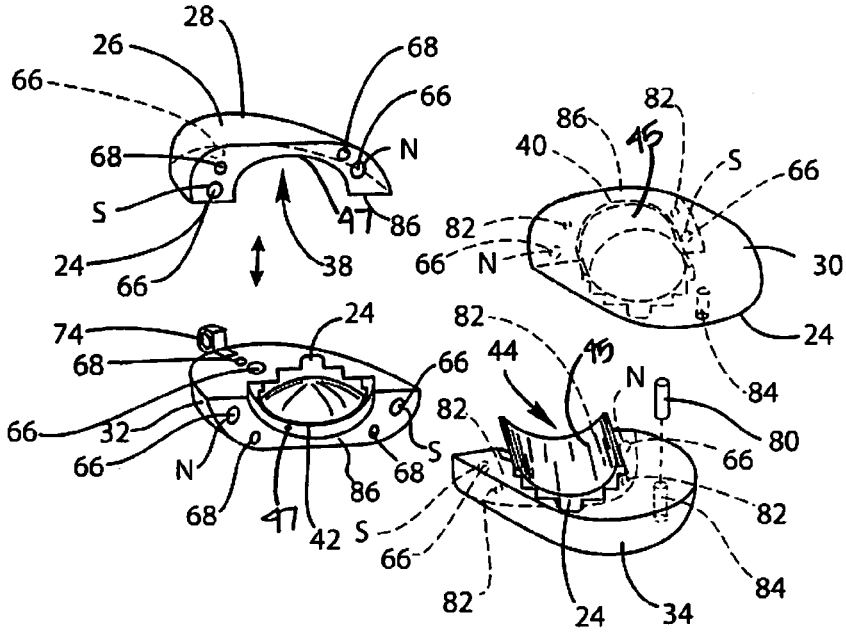
FIG. 6 is a perspective, exploded view of the four quarter units of the locket.

FIG. 6 shows an exploded view of the locket of the invention. In this view the four quarters are shown without being attached to any of the other four quarters. Shown in this view are a number of positioning magnets 66, with magnets positioned in opposing pairs with opposite polarity on each of the edgefaces 86. Adjacent to the positioning magnets 66 on the edgefaces 86 are several detents 68. Opposite from the detents 68 on one of the edge faces 86 are corresponding detent recesses 82. In addition to detents 68 and the detent recesses 82 positioned on the edgefaces 86, detents and detent recesses can also be positioned on the inner faces 24. The polarity of the positioning magnets is arranged so that, when the four quarters are in the correct position, each of the ten magnets is adjacent to a magnet of the opposite polarity. This causes the locket to clamp itself into shape by magnetic attraction. Conversely, when the locket is rotated in other positions, the magnets are arranged so that, when the locket quarters are in transition positions the magnets pass by other magnets of the same polarity, causing repulsion of the magnets until they are in the correct position.

Shown in FIG. 6 is a shaft 80, which corresponds to a shaft tube 84, which forms the rotating joint 46 of the invention and which allows the locket to form the shape shown in FIG. 2. A half cylinder projection 45 is shown as part of swivel $4^{th}$ quarter 44, with a corresponding half cylinder recess 47 formed in third swivel unit 42. A similar half cylinder projection 45 and recess 47 are shown respectively in swivel quarter units 40 and 38.

Figure 7:
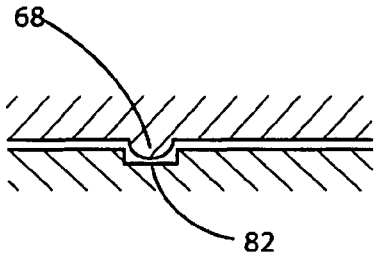
FIG. 7 is a cross-sectional view of the detail showing a detent fitting into a detent recess.
Figure 8:
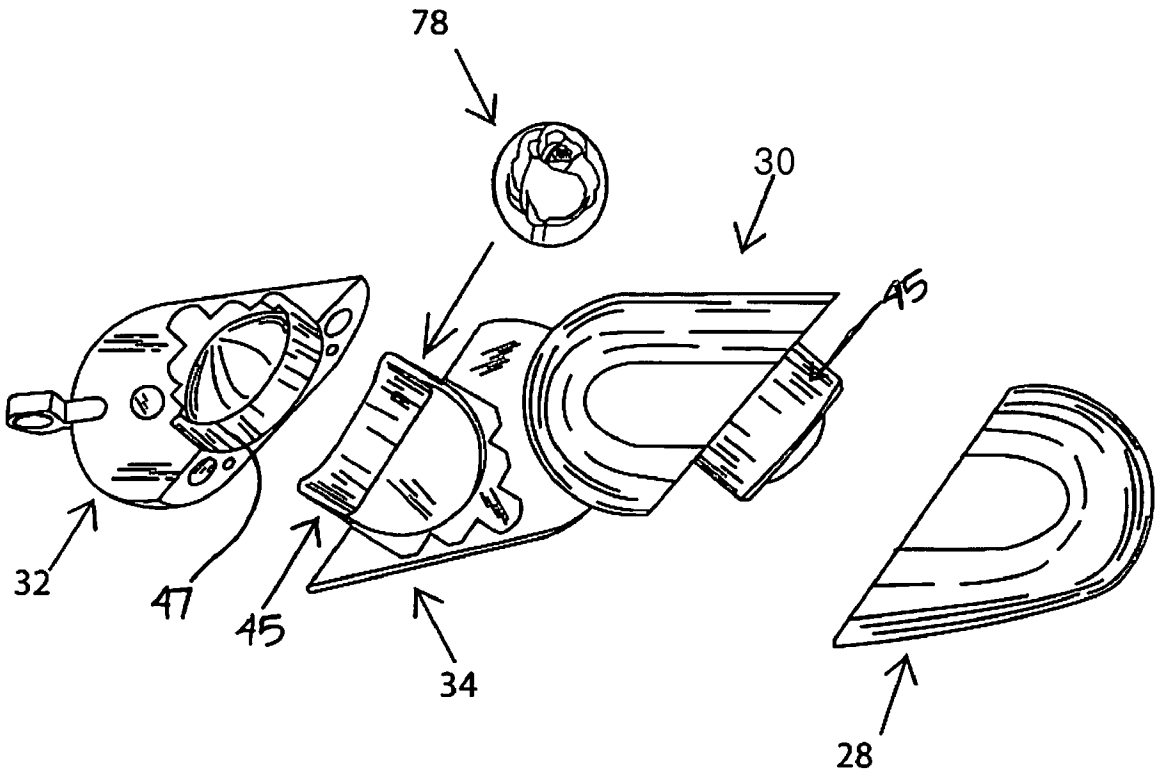
FIG. 8 is a view of the 4 quarters of the locket partially disassembled.
Figure 9:
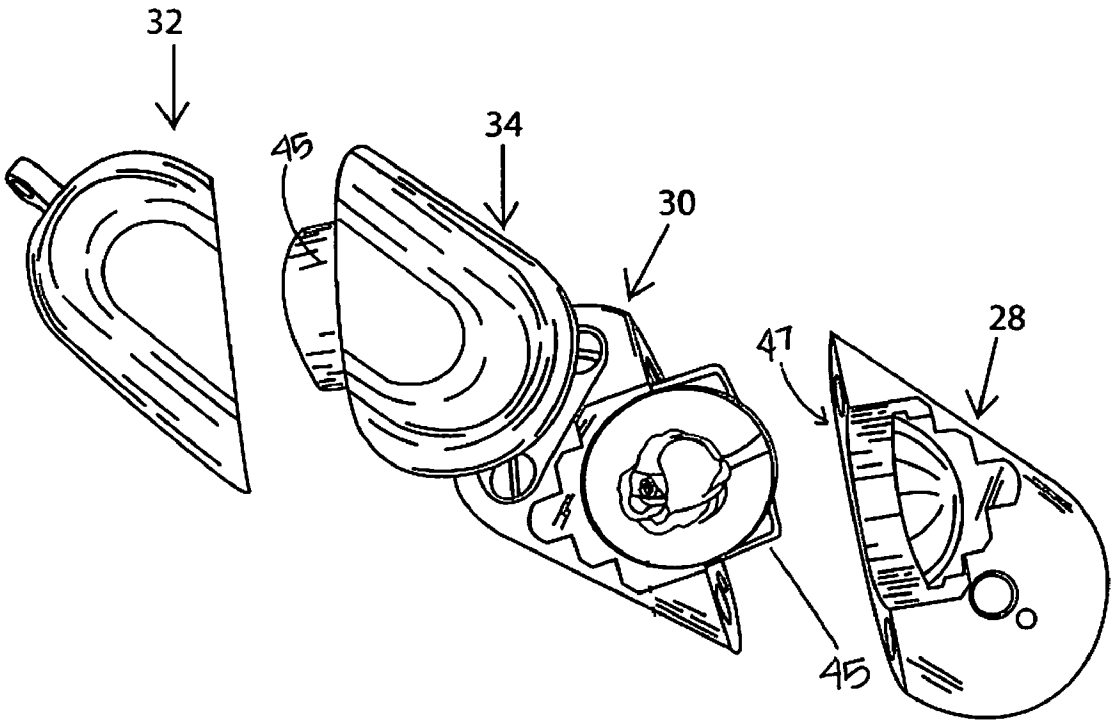
FIG. 9 is a view of the 4 quarters of FIG. 8, showing the reverse side of each section.

FIG. 7 shows the detent 68 and a detent recess 82 of the invention. In this case, the detent 68 is merely a slight protrusion from the face of one of the quarters. The detent recess 82 corresponds to the detent, and is a slight recession which corresponds to the size and depth of the detent 68. The detents can take a number of forms, including ball detents, or mere protrusions of the substrate material of the quarters. The purpose of the detents is to precisely align the quarters of the locket together so that it can freely rotate between the oval and heart shapes and so the halves can easily open to reveal the pictures.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A folding locket comprising;

a swivel joint comprised of a first, second, third, and fourth swivel joint quarter, with said second swivel joint quarter having a half cylinder projection with a retaining ridge that engages a rim on said first swivel joint quarter;

with said fourth swivel joint quarter having a half cylinder projection with a retaining ridge that engages a rim on said third swivel joint quarter;

a first, second, third and fourth locket quarter unit, with each said locket quarter unit attached one of each of said first, second, third and fourth swivel joint quarters, respectively, with said first and second locket quarter units forming a first locket half, and said third and fourth locket quarter units forming a second locket half, with said first and second locket halves joined at said second and fourth quarter unit by a rotating joint, with said first and third quarter units each having a releasable connector for releasably connecting said first and third quarter units;

with said first and second locket halves joined to each other for independent rotation of said locket halves around said rotating joint; and with said first and third locket quarter units further configured to rotate relative to said second and fourth locket quarters and to attach to each other by said releaseable connector.

2. The folding locket of claim 1 in which said locket has a long axis, and further comprises a first joint line between said first quarter unit and said second quarter unit, with said first joint line being at a non-perpendicular angle from said long axis, with said first joint line being an interface between said first quarter unit and said second unit, and a second joint line between said third and fourth quarter unit, with said second joint line being at a non-perpendicular angle from said long axis, coplanar and parallel with said first joint line, with said second joint line being an interface between said third quarter unit and said fourth unit, with said joint lines congruent to each other and at an angle to the locket when in a first generally oval position, so that when said second quarter unit and said fourth quarter unit rotate to a second position, the four quarter units form a generally heart shaped locket.

3. The folding locket of claim 1 which said releasable connector further comprises at least one pair of positioning magnets for holding said locket first and third quarter units in desired positions.

4. The folding locket of claim 1 which further comprises a plurality of positioning magnets positioned with north and south poles oriented for repulsion of corresponding magnets between the first and second position, and for attraction of corresponding magnets when in said first or second position, thereby urging the locket into either the first or second position.

5. The folding locket of claim 1 which further comprises one or more protruding detents on a first locket face configured to interact with a corresponding concave depression on a second locket face, for guiding said first locket face into exact register with said second locket face.

6. A folding locket, comprising:

a generally oval first half of said locket, comprising a first quarter unit and a second quarter unit joined rotatably to each other, with said first locket half having a long axis, and further comprising a first end, and a second end, and an inner face and an outer surface, with said first quarter unit and said second quarter unit of said locket rotatably joined to each other by a first quarter of a swivel joint as part of said first quarter unit of said locket, and with a second quarter of said swivel joint as part of said second quarter unit of said locket, with said swivel joint configured to allow said first quarter unit of said locket to rotate in relation to said second quarter unit of said locket;

a generally oval second half of said locket, rotatably attached to said second end of said first half of said locket, said second locket half comprising a third quarter unit and a fourth quarter unit joined rotatably to each other, with said second locket half having a long axis, and further comprising a first end, and a second end, and an inner face and an outer surface, said third quarter unit and said fourth quarter unit of said locket rotatably joined to each other by a third quarter of said swivel joint as part of said third quarter unit of said locket, and with a fourth quarter of said swivel joint as part of said fourth quarter unit of said locket, with said swivel joint third and fourth quarters configured to allow said third quarter unit of said locket to rotate in relation to said fourth quarter unit of said locket;

and comprising a rotating joint for rotational attachment of said first half of said locket to said second half of said locket, with said oblong first and second halves of said locket forming a first position with said inner faces in contact; and a first joint line between said first quarter unit and said second quarter unit, with said first joint line configured to align with a second joint line between said third quarter unit and said fourth quarter unit, so that said first quarter unit and said third quarter unit can rotate together in relation to said second and fourth quarter units to a second position.

7. The folding locket of claim 6 in which said first half of said locket has a first picture mounting position, positioned across said first joint line.

8. The folding locket of claim 6 in which said second half of said locket has a second picture mounting position for a picture, positioned across said second joint line.

9. The folding locket of claim 6 in which said first half of said locket comprises a first picture mounting position.

10. The folding locket of claim 6 in which said second half of said locket half comprises a second picture mounting position.

11. The folding locket of claim 6 in which said first and second joint lines are at an angle to the locket when in said first position, so that when said second and fourth quarter units rotate to said second position, the four quarter units form a generally heart shaped locket.

12. The folding locket of claim 6 which further includes a plurality of positioning magnets for holding said locket quarter units in stable engagement in said first position and in said second position.

13. The folding locket of claim 12 in which said positioning magnets are positioned with north and south poles arranged so that the sections repel each other in transit, and attract when in the first or second position.

* * * * *